United States Patent [19]

Young

[11] 4,080,010

[45] Mar. 21, 1978

[54] TANDEM ROLLER STABILIZER FOR EARTH BORING APPARATUS

[75] Inventor: Jerry Olympus Young, Midland, Tex.

[73] Assignee: Smith International, Inc., Midland, Tex.

[21] Appl. No.: 720,954

[22] Filed: Sep. 7, 1976

[51] Int. Cl.[2] ..... E21B 17/10

[52] U.S. Cl. ..... 308/4 A; 175/76; 175/406; 308/8.2

[58] Field of Search ..... 308/4 R, 4 A, 8.2; 166/241; 175/76, 325, 406, 408, 73

[56] References Cited

U.S. PATENT DOCUMENTS

| | | | |
|---|---|---|---|
| 1,776,611 | 9/1930 | Akeyson | 175/406 |
| 3,400,773 | 9/1968 | Tiraspolsky et al. | 175/325 |
| 3,413,045 | 11/1968 | Wohlfeld | 308/6 |
| 3,754,609 | 9/1970 | Garrett | 175/325 |
| 3,933,395 | 1/1976 | Evans | 308/4 A |
| 3,982,594 | 9/1976 | Berthiaume | 308/8.2 |

*Primary Examiner*—Trygve M. Blix
*Assistant Examiner*—Charles E. Frankfort
*Attorney, Agent, or Firm*—Murray Robinson; Ned L. Conley; David Alan Rose

[57] ABSTRACT

The eccentric journals of a tandem roller stabilizer are azimuthally positioned relative to each other by multiple lead threads on the mandrel onto which the journals of the successive roller assemblies are screwed, the journal of each roller assembly having like multiple lead thread of an integral number of turns per lead. In assembling the successive journals on the mandrel each journal is started on the lead immediately adjacent to the lead on which the preceding journal was assembled, progressing continuously in the same direction around the mandrel, whereby each journal is displaced azimuthally from adjacent rollers by an angle $x$ equal to $360/n°$ where $n$ is the thread multiplicity and is equal to the number of roller assemblies on the stabilizer.

15 Claims, 5 Drawing Figures

TANDEM ROLLER STABILIZER FOR EARTH BORING APPARATUS

CROSS-REFERENCES TO RELATED APPLICATIONS

The invention herein disclosed is an improvement upon the prior invention of Jackson M. Kellner set forth in the latter's United States patent application thereon entitled Stabilizer, Ser. No. 720,695, filed Sept. 7, 1976, executed circa contemporaneously herewith, assigned to the same assignee as the present application.

Two other United States patent applications by said Jackson M. Kellner also entitled Stabilizer, Ser. No. 721,089, filed Sept. 7, 1976 and Ser. No. 721,090, filed Sept. 7, 1976, also assigned to the same assignee as the present application, are believed to be later inventions than the present invention.

BACKGROUND OF THE INVENTION

This invention relates to earth boring apparatus and more particularly to roller stabilizers useful in the rotary system of boring blast holes.

Difficulty has been experienced with stabilizers of the type employing plural colevel rollers mounted on parallel off-axial journals when the hole size is increased, e.g., up to 15 or more inches in diameter. Larger bearing diameters are needed to accommodate the large lateral loads without undue wear. A similar problem arises with roller reamers, which are similar to stabilizers, the latter being undergage while reamers are full gage. A solution to the problem is the employment of tandem rollers mounted on eccentric journals extending around the stabilizer mandrel. Such construction is already known, e.g. for roller stabilizers, as shown in U.S. Pat. No. 3,400,773 to TIRAPOLSKY et al. See also U.S. Pat. No. 1,772,491 to Koppl.

With tandem rollers it is necessary to orient the eccentric journals azimuthally relative to each other in order to distribute the lateral loading uniformly about the axis of the stabilizer mandrel. Otherwise the rollers would cause the mandrel to deflect and reduce the effectiveness of the stabilizer. In this regard Tirapolsky, referring to the elements on which the rollers rotate as hubs, states:

> "A suitable assembly can be obtained by connecting the hubs of the consecutive reaming elements by coupling rings in which the hubs are screwed but it is very difficult in this way to obtain a correct relative angular positioning of the axes of the hubs around the axis of the body of the remaining tool.
>
> Another solution is the use of a shaft for the reaming tool on which eccentric hubs are mounted and the rollers turn on these hubs on axes parallel to the shaft with the hubs being fastened to the shaft for rotation either by keying on the shaft or by utilization of a shaft having a polygonal section.
>
> Any of the solutions discussed above require a shaft having a cross-section sufficient to transmit large forces of rotation to the reaming elements.
>
> An object of the present invention is to provide a rigid assembly of reaming elements in which the transmission of the torque to these reaming elements is provided by the assembly itself which is solidly and directly connected to the driving shaft of the bottom motor which drives the tool in rotation."

Tirapolsky employs rings between his hubs, the rings having eccentric sockets to receive and position the hubs, which are largely out of contact with the mandrel.

Koppl employs a polygonal section shaft, as mentioned by Tirapolsky.

SUMMARY OF THE INVENTION

According to the invention the several eccentric journals of a tandem roller stabilizer are azimuthally positioned relative to each other by multiple lead threads on the mandrel onto which the journals of the successive roller assemblies are screwed, the journal of each roller assembly having like multiple lead threads of an integral number of turns per lead. In assembling the successive journals on the mandrel each journal is started on the lead immediately adjacent to the lead on which the preceding journal was assembled, progressing continuously in the same direction around the mandrel, whereby each journal is displaced azimuthally from adjacent rollers by an angle $x$ equal to $360/n$ ° where $n$ is the thread multiplicity and is equal to the number of roller assemblies on the stabilizer.

BRIEF DESCRIPTION OF THE DRAWINGS

For a more detailed description of a preferred embodiment of the invention reference will now be made to the accompanying drawings wherein.

DESCRIPTION OF PREFERRED EMBODIMENT

Stabilizer Assembly

Figure 1:
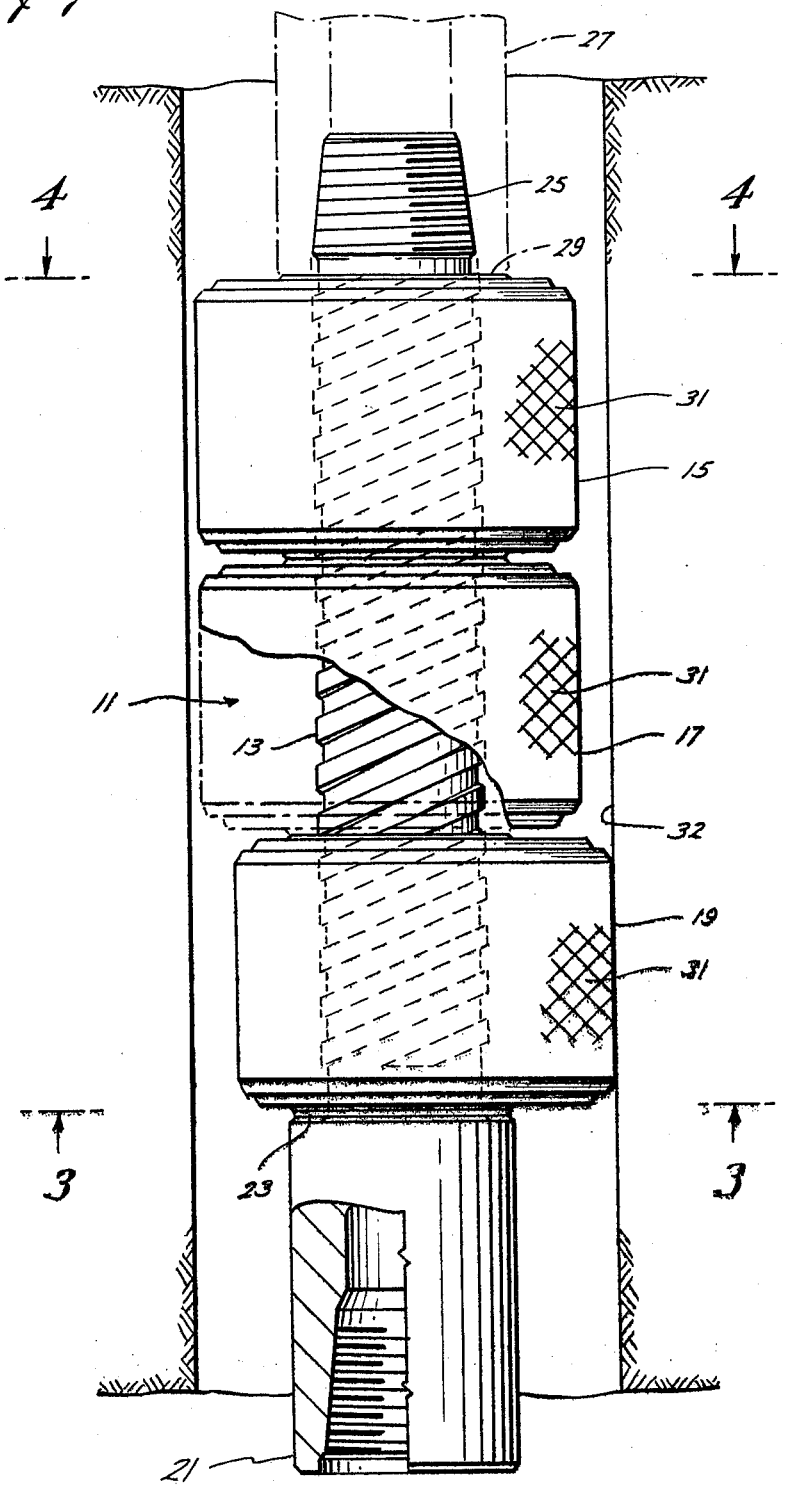
FIG. 1 is a side elevation of a stabilizer embodying the invention, one of the roller assemblies being partially broken away to expose the mandrel.

Referring now to FIG. 1 there is shown a stabilizer comprising a tubular body 11 including mandrel portion 13, the outer periphery of which is adapted to receive the roller assemblies 15, 17, 19. Adjacent one end of the mandrel the body is provided with an internally taper threaded box 21 for making a rotary shouldered connection with an adjacent drill string member, e.g. a bit. For a more detailed disclosure of rotary shouldered connections see U.S. Pat. No. 3,754,609 to Garrett.

A shoulder 23 is formed at the juncture of the box 21 and the mandrel 11, providing stop means at one end of the mandrel limiting axial motion of the roller assemblies relative to the mandrel in the direction toward the box. At the other end of the mandrel the body 11 is provided with an externally taper threaded pin 25 for making a rotary shouldered connection with another drill string member, e.g. a tool joint box 27 on the lower end of a drill collar or a sub. The shoulder 29 provided by the mouth of the box 27 provides stop means to prevent axial motion of the roller assemblies relative to the mandrel in the direction toward pin 25. When the box 27 is made up tight on pin 25 the roller assemblies are axially compressed against shoulder 23 and transmit torque between the shoulder 29 and shoulder 23 in the manner described in the aforementioned Garrett patent, and to some degree in the manner described in the aforementioned Torapolsky et al. patent.

The outer peripheries of the roller assemblies are provided with suitable wear reducing means such as inserted tungsten carbide buttons, as is disclosed in the 1974–75 edition of the Composite Catalogue of Oilfield Equipment and Service at page 1774, and in U.S. Pat. Nos. 3,667,817 (Kellner), 3,285,678 (Garrett and Crews), and 3,306,381 (Garrett & Moore). Generalized wear reducing means is indicated at 31 on each of the roller assemblies. Such means 31 on roller assembly 19 is shown to be in contact with the wall 32 of the bore hole. The wall contacting portions of the other roller assemblies are displaced azimuthally from that of the adjacent roller assemblies by an angle X equal to 360° divided by the number of roller assemblies. With three roller assemblies the wall contacting portions are spaced apart 120°. Orienting means for effecting this result will be described later on hereinafter. Any desired number of roller assemblies can be used, for example two through six or more roller assemblies.

Roller Assembly

Figure 2:
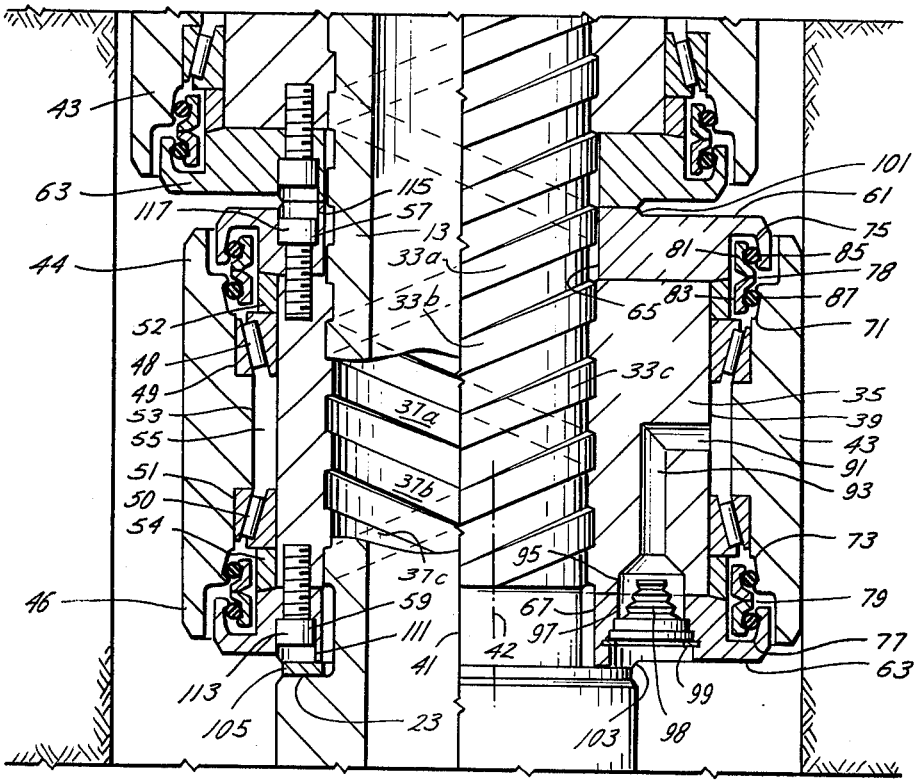
FIG. 2 is an axial section through one of the roller assemblies and associated portions of the mandrel on which it is mounted.

Referring now to FIG. 2, the mandrel 13 has triple lead threads 33*a*, 33*b*, 33*c* on its outer periphery, screwed on to which are screwed the three roller assemblies 15, 17, 19. Each roller assembly, e.g. 19, includes a journal 35 having a generally cylindrical bore in which there are a triple lead thread 37*a*, 37*b*, 37*c*, correlative to the thread 33*a–c* on the mandrel on to which it is screwed.

The outer periphery 39 of the journal is a smooth cylindrical surface eccentric to the axis of the bore of the journal and the axis 41 of the mandrel. The axis of the eccentric outer periphery of the journal is indicated at 42.

Rotatably mounted on journal 35 is generally cylindrical annular roller 43. The roller 43 is of about the same axial extent as journal 35 except for cylindrical cuffs 44, 46 at the upper and lower ends of the roller. Wear reducing means 31 on the outer periphery of the roller is concentric with journal axis 42.

Roller thrust bearings 48, 50 have their outer races received within cylindrical bores 49, 51 in the ends of the roller. The inner races of the bearings are fitted snugly over the outer periphery of the journal. Bearings 48, 50 provide bearing means for the rollers cooperating with the journal 35 eccentrically rotatably mounting the roller on the reamer body.

Bearings 48, 50 may be press fitted in roller 43. The inner diameters of the inner races of the bearings are smaller than the inner diameter of the mid-portion 53 of the inner periphery of roller 43. This leaves an annular space 55 between the roller and the journal which is filled with lubricating and cooling fluid, e.g. a liquid such as oil.

Spacer rings 52, 54 are slipped over the outer periphery of the journal adjacent the inner races of bearings 48, 50.

Figure 3:
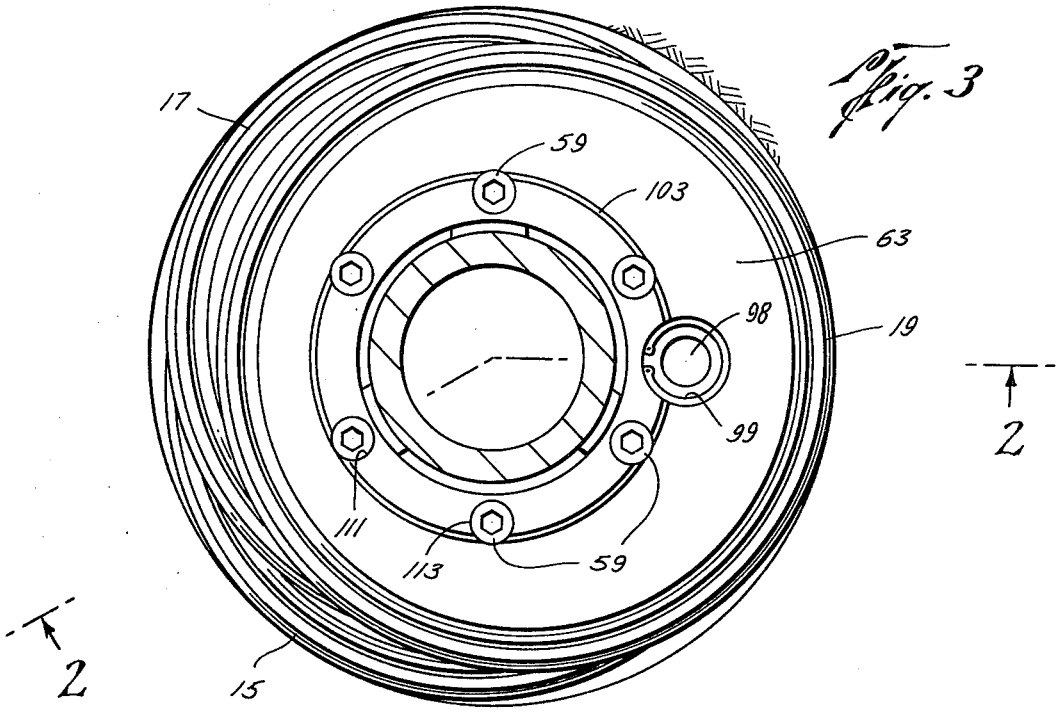
FIG. 3 is a transverse section taken on a plane indicated at 3—3 on FIG. 1 and showing a bottom end view of the roller assembly shown in FIG. 2.

Screwed to the upper and lower ends of journal 35 by rings of cap screws or bolts 57, 59 (see also FIG. 3) are end plates 61, 63. The end plates are eccentrically apertured at 65, 67 to fit snugly around the mandrel. The outer peripheries of the end plates are of larger diameter than the journal, extending out over the inner portions of the ends of the roller to just inside cuffs 44, 46. The plates overlap the ends of the spacer rings 52, 54 and in cooperation with thrust bearings 48, 50 prevent axial motion of the roller 43 relative to the journal 35.

The inner portions of the ends of the roller are provided with annular pockets 71, 73. The seal plates are provided with annular pockets 75, 77 registering with pockets 71, 73. Disposed within the upper pair of pockets 71, 75 is a suitable rotating seal means 78. A similar rotating seal means 79 is disposed in the lower pair of pockets 73, 77. Preferably, as shown, each such seal means is a seal made by the Caterpillar Tractor Company known in the art as a Caterpillar seal. Such a seal comprises a pair of flat faced metal bearing rings 81, 83 urged into contact by a pair of elastomeric toruses or O-rings 85, 87. The outer walls of the pockets in the end plates and the outer peripheries of the bearing rings are tapered so that the O-rings exert axial pressure on the bearing rings to cause a seal therebetween. One bearing ring of each seal means remains stationary relative to the adjacent end plate and the other bearing ring turns with the adjacent roller.

The clearance space between the end plates, roller, and journal, including space 55, sealed off by the seal means 78, 79, provide a reservoir for the lubricating and cooling liquid or oil. Radial and axial ports 91, 93 in the thickest part of the journal connect space 55 with fill opening 95 in the lower end of the roller. In register with fill opening 95 is fill port 97 in the lower end plate 63 which is closed by means of a suitable volume compensator, such as a flexible diaphragm 98, releasably held in place by a split resilient ring 99. The volume compensator allows the oil in the reservoir to expand when heated, thereby preventing oil loss through the seal means 78, 79.

The end plates 61, 63 are provided with annular bosses 101, 103. These bosses engage like bosses on the end plates of adjacent roller assemblies, except the lowermost boss engages a washer 105 adjacent shoulder 23 on the stabilizer body and the uppermost boss engages the shoulder 29 formed by the lower end of the tool joint box 27. It is through these bosses that most of the torque is transmitted to and through the roller assemblies from shoulder 23 to shoulder 29 when the stabilizer is in use, only a small fraction of the torque being transmitted through the threads of box 25 to the reamer body.

It will be noted that the lower end plate 63 of each roller assembly is provided with countersink bores 111 which have depths greater than the lengths of the heads 113 of the bolts or cap screws 59 received therein. The upper end plate 61 of each roller assembly is similarly provided with countersink bores 115 which have depths greater than the lengths of the heads 117 of the bolts or cap screws 59 received therein. When the bolts are in place the heads of the bolts do not protrude beyond the plate and do not interfere with torque transmission through bosses 101, 103.

Roller Assembly Orientation

Each of the journals 35 is of the same length and has a length sufficient precisely to accommodate one or more full turns of the three threads 37*a*, 37*b*, 37*c*. Otherwise stated the journal thread length is equal to $(n)(360)°$ where $n$ is an integer. When the roller assemblies are screwed onto the mandrel, each journal is started 120° from the azimuthal starting position of the journal of the previously screwed on roller assembly.

Figure 4:
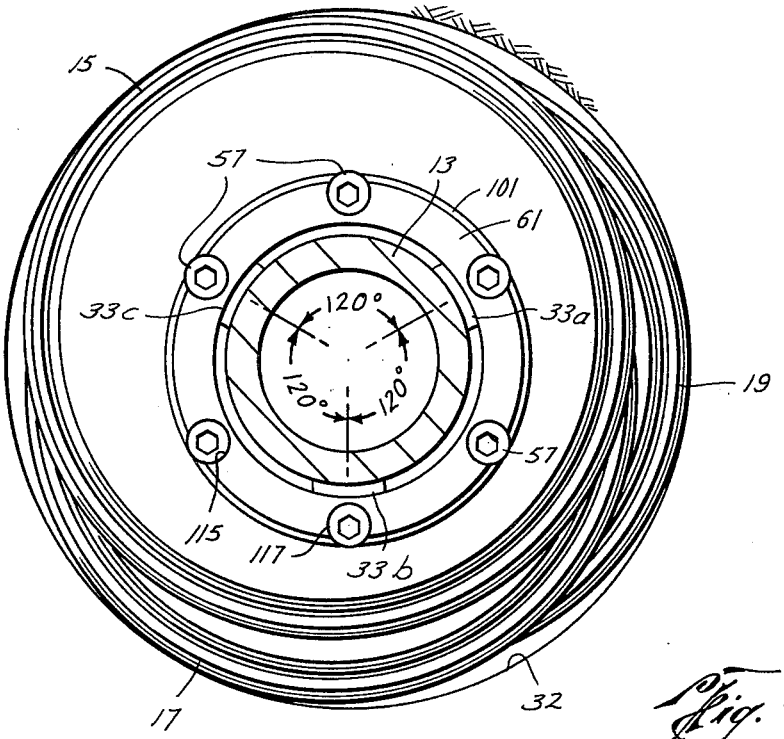
FIG. 4 is a transverse section through the stabilizer body taken on a plane between the mandrel and the pin at the upper end of the mandrel looking down at the upper end of the mandrel.

Referring to FIG. 4, the upper ends of the three threads 33*a*, 33*b*, 33*c* are 120° apart. The lower ends of the threads 37*a*, 37*b*, 37*c* on each journal are similarly displaced 120°. Assuming that the lowermost roller 19 is started with its thread 37*a* between journal threads 33*a* and 33*b*, then roller 17 would be started with its thread 37*a* between journal threads 33*b* and 33*c* (or between threads 33*a* and 33*c*). Then roller 15 would be started with its thread 37*a* between journal threads 33*a* and 33*c* (or between threads 33*b* and 33*c* if the thread 37*a* of roller 17 is started between journal threads 33*a* and 33*c*). Since the journal threads are an integral number of turns in length, the above-described mode of assembly will cause each journal to be displaced azimuthally from adjacent rollers by 120°. For example, the position of each journal can be described with reference to its common eccentric diameter, that is, a diameter passing through both its bore axis 41 and the axis 42 of its outer periphery. By the prescribed method of assembly the roller assemblies are positioned with the common eccentric diameters of their journals disposed 120° apart. The points of contact of the three roller assemblies with the wall 32 of the bore hole are likewise positioned 120° apart.

If desired, the stabilizer could be provided with more or less roller assemblies. Also, more or less thread multiplicity on the mandrel and journals could be employed to position the journals at angles of $(360/m)°$ where $m$ is the thread multiplicity. To have equiangular positioning of the rollers all around the mandrel, the number of roller assemblies should be equal to an integral multiple of the thread multiplicity.

Although the subject invention is intended for use as a stabilizer, e.g. for blast hole drilling, it is of more general utility; and its principles may also be employed for reamers. For this reason the invention may be referred to in the claims as a Wall Contacting Tool.

Figure 5:
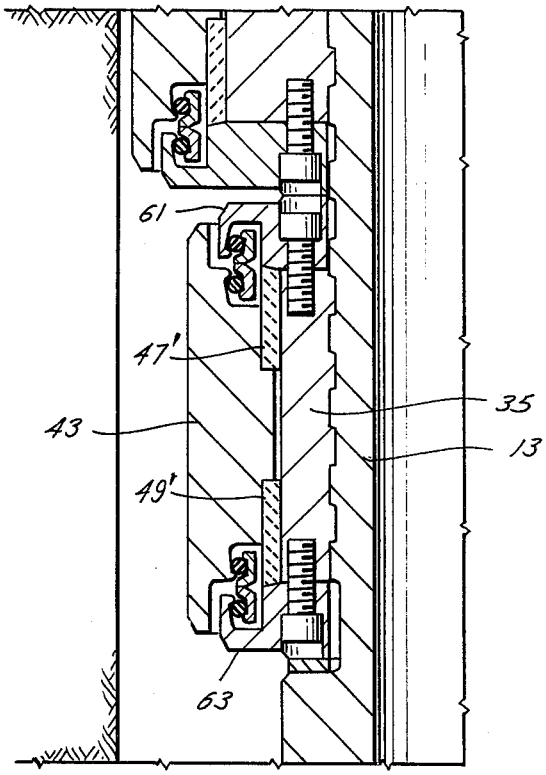
FIG. 5 is a view similar to FIG. 2 showing a modification.

While a preferred embodiment of the invention has been shown and described, many modifications could be made by one skilled in the art without departing from the spirit of the invention. For example, instead of roller thrust bearings, simple bushings could be employed as shown at 47′, 49′ in FIG. 5. Other forms of bearings could be employed.

I claim:

1. Wall contacting tool comrpising a mandrel having a plurality of eccentric roller assemblies disposed in tandem along the length of the mandrel, said mandrel and each of said roller assemblies being provided with cooperative screw thread means of but a single hand to position the assemblies with predetermined azimuthal orientation of their common eccentric diameters, at least two of said roller assemblies having different orientation of said diameters.

2. Wall contacting tool according to claim 1 in which each of said screw thread means on said roller assemblies is of the same length.

3. Wall contacting tool according to claim 1 in which the length of said screw thread means on each roller assembly is equal to $(n)(360)°$ where each $n$ is an integer.

4. Wall contacting tool according to claim 3 in which $n$ is the same for each roller assembly.

5. Wall contacting tool according to claim 1 in which said screw thread means is untapered, said mandrel having a shoulder at one end and tapered screw thread means at the other end, and removable shoulder means at said other end of the mandrel having a tapered screw thread adapted to engage said tapered screw thread means on the mandrel and place said roller assemblies in axial compression between said shoulder and shoulder means.

6. Wall contacting tool comprising a mandrel having a plurality of eccentric roller assemblies disposed in tandem along the length of the mandrel, said mandrel and each of said roller assemblies being provided with cooperative screw thread means to position the assemblies with predetermined azimuthal orientation of their common eccentric diameters, each said screw thread means being a multiple lead thread having a thread multiplicity equal to the number of roller assemblies.

7. Wall contacting tool according to claim 6 in which the corresponding valleys between the threads of said screw thread means of said roller assemblies are each mated with a different one of the threads of said screw thread means on the mandrel.

8. Wall contacting tool according to claim 6 in which said screw thread means on each roller assembly is of the same length.

9. Wall contacting tool according to claim 7 in which said screw thread means on each roller assembly has a length of $(n)(360)°$ per thread where each $n$ is an integer.

10. Wall contacting tool according to claim 9 where $n$ is the same for each roller assembly.

11. Wall contacting tool according to claim 10 in which the common eccentric diameter of each roller assembly being azimuthally displaced from such diameter of adjacent assemblies by $360/m°$ where $m$ is the thread multiplicity.

12. Wall contacting tool according to claim 10 in which said roller assemblies are of the same length and are disposed with their common eccentric axes equiazimuthally spaced apart.

13. Wall contacting tool comprising a tubular body including a mandrel having at one end a threaded pin adapted to receive a releaseable box and having a threaded box at the other end forming a shoulder with the mandrel, and a plurality of roller assemblies releaseably mounted on said mandrel, being removable from the mandrel when said releaseable box is removed, said mandrel having orienting thread means on its outer periphery, each roller assembly comprising:

a journal in the form of a sleeve having a threaded inner periphery adapted to be screwed onto said mandrel and having an outer periphery eccentric to said inner periphery, a roller rotatably mounted on the journal, and thrust means secured to each end of the journal retaining the rollers against axial displacement relative to the journal, the adjacent journals of each adjacent pair of roller assemblies being azimuthally oriented by said orienting thread means on the mandrel onto which said journals are secured, at least two of said journals being differently azimuthally oriented.

14. Wall contacting tool according to claim 13 in which said thrust means are plates having eccentric apertures, each said aperture being in registry with the inner periphery of the journal to which the plate is secured, said apertures being of a diameter as large as the thread valley of the inner periphery of the journal to which the plate is secured, the common eccentric diameter of each plate having the same azimuth relative to the mandrel as such diameter of the journal to which it is secured.

15. Wall contacting tool comprising a tubular body including a mandrel having at one end a threaded pin adapted to receive a releaseable box and having a threaded box at the other end forming a shoulder with the mandrel, and a plurality of roller assemblies releaseably mounted on said mandrel, being removable from the mandrel when said releaseable box is removed, said mandrel having orienting thread means on its outer periphery, each roller assembly comprising:

a journal in the form of a sleeve havinga threaded inner periphery adapted to be screwed onto said mandrel and having an outer periphery eccentric to said inner periphery, a roller rotatably mounted on the journal, and thrust means secured to each end of the journal retaining the rollers against axial displacement relative to the journal, the adjacent journals of each adjacent pair of rollers being azimuthally oriented by said orienting thread means on the mandrel onto which said journals are secured, said thrust means are plates having eccentric apertures, each said aperture being registry with the inner periphery of the journal to which the plate is secured, said apertures being of a diameter as large as the thread valley of the inner periphery of the journal to which the plate is secured, the common eccentric diameter of each plate having the same azimuth relative to the mandrel as such diameter of the journal to which it is secured each plate being secured to the associated journal by a circle of bolts and provided on its outer face with an annular boss in which the heads of said bolts are counter sunk, said bosses of adjacent plates being in torque transmitting frictional engagement when said roller assemblies are screwed onto said mandrel and clamped between said shoulder and said releaseable box.

* * * * *

UNITED STATES PATENT OFFICE

CERTIFICATE OF CORRECTION

Patent No. 4,080,010 Dated March 21, 1978

Inventor(s) JERRY OLYMPUS YOUNG

It is certified that error appears in the above-identified patent and that said Letters Patent are hereby corrected as shown below:

Column 5, line 46, change "comrpising" to --comprising--.

Column 7, line 14, change "havinga" to --having a--.

Column 8, line 5, after "being" insert --in--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*